US008440027B2

(12) United States Patent
Bühlmeyer et al.

(10) Patent No.: US 8,440,027 B2
(45) Date of Patent: May 14, 2013

(54) DISHWASHER HAVING A COMPARTMENT COVER MADE OF LOW-COST STEEL, A FRAME OF HIGH-GRADE STEEL AND A DISHWASHER TRAY MADE OF PLASTIC

(75) Inventors: Alexander Bühlmeyer, Bopfingen (DE); Werner Haltmayer, Dinkelsbühl (DE); Cengiz Kücük, Syrgenstein (DE); Manfred Seeβle, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1015 days.

(21) Appl. No.: 12/085,069

(22) PCT Filed: Nov. 28, 2006

(86) PCT No.: PCT/EP2006/068988

§ 371 (c)(1),
(2), (4) Date: May 15, 2008

(87) PCT Pub. No.: WO2007/074008

PCT Pub. Date: Jul. 5, 2007

(65) Prior Publication Data

US 2009/0126765 A1 May 21, 2009

(30) Foreign Application Priority Data

Dec. 27, 2005 (DE) ..... 10 2005 062 478

(51) Int. Cl.
*B08B 3/04* (2006.01)

(52) U.S. Cl.
USPC ..... 134/56 D; 134/57 D; 134/58 D; 134/114; 134/115 R; 312/228.1

(58) Field of Classification Search ..... 134/56 D, 134/57 D, 58 D, 115 R, 114; 312/228, 228.1, 312/229
See application file for complete search history.

(56) References Cited

U.S. PATENT DOCUMENTS 3,443,719 A 5/1969 Duncan
3,530,864 A * 9/1970 Wright ..... 134/58 D (Continued)

FOREIGN PATENT DOCUMENTS

DE 44 43 919 6/1996
DE 19624889 A1 * 6/1997

(Continued)

OTHER PUBLICATIONS

Machine translation of DE 4443919 A1 to Snickel, Jun. 1996.*

(Continued)

*Primary Examiner* — Michael Barr
*Assistant Examiner* — Benjamin L Osterhout
(74) *Attorney, Agent, or Firm* — James E. Howard; Andre Pallapies

(57) ABSTRACT

A domestic dishwasher includes a compartment casing comprising a corrosion-resistant metal, and a frame comprising a metal that is more corrosion-resistant than the compartment casing.

20 Claims, 4 Drawing Sheets

U.S. PATENT DOCUMENTS

| | | | | |
|---|---|---|---|---|
| 3,829,191 | A * | 8/1974 | Jenkins | 312/228.1 |
| 4,295,692 | A * | 10/1981 | Jenkins | 312/228 |
| 4,359,250 | A * | 11/1982 | Jenkins | 312/228 |
| 4,746,177 | A | 5/1988 | Lampman et al. | |
| 4,940,298 | A | 7/1990 | Jackson et al. | |
| 6,045,203 | A | 4/2000 | Marks et al. | |
| 6,045,205 | A * | 4/2000 | Dingler | 312/351.7 |
| 6,435,366 | B1 | 8/2002 | Johnson et al. | |
| 6,764,147 | B2 * | 7/2004 | Flowers | 312/228 |
| 6,823,878 | B1 * | 11/2004 | Gadini | 134/58 D |
| 2004/0201334 | A1 * | 10/2004 | Williams et al. | 312/228 |

FOREIGN PATENT DOCUMENTS

| | | |
|---|---|---|
| EP | 0 243 632 | 11/1987 |
| GB | 1 403 953 | 8/1975 |
| WO | WO 2007/048697 | 5/2007 |

OTHER PUBLICATIONS

Machine Translation of DE 19624889 to Lehmann, Jun. 1997.*

International Search Report PCT/EP2006/068988.

* cited by examiner

DISHWASHER HAVING A COMPARTMENT COVER MADE OF LOW-COST STEEL, A FRAME OF HIGH-GRADE STEEL AND A DISHWASHER TRAY MADE OF PLASTIC

BACKGROUND OF THE INVENTION

1. Field of the Invention

The present invention relates to dishwasher compartments and frames. More particularly, the present invention relates to an improved configuration of a dishwasher compartment and frame.

2. Description of Related Art

The dishwashing compartment of dishwashers is normally manufactured from a high-grade stainless special steel. The dishwashing compartment consists of at least two component parts. The so-called compartment casing forms the side walls and also the roof of a compartment casing of the dishwashing compartment and is connected to a separately formed rear wall which is likewise a component part of the compartment casing. For reasons of corrosion resistance the component parts of the compartment casing are manufactured from a high-grade chrome-nickel steel which is relatively expensive. The use of chrome-nickel steel results from the fact that the rear wall is connected to the compartment casing by way of a weld. The use of chrome-nickel steel ensures that the corrosion resistance is also guaranteed on the weld seams.

For reasons of cost it would be preferable if important component parts of the compartment casing could be manufactured from a simpler chrome steel because the costs of production could then be reduced. Compared with chrome-nickel steel, chrome steel exhibits a lower corrosion resistance. If chrome steel is exposed to water or humidity over an extended period of time, for example in crevices or behind seals on dishwashing compartments, corrosion occurs. Furthermore, with regard to the connection of chrome steel and chrome-nickel steel by way of a weld in the case of dishwashers, so-called crevice corrosion occurs in the joint area. It is likewise also possible for crevice corrosion to occur in the situation when the entire compartment casing is manufactured from a chrome steel compound.

For this reason, as already described in the introduction, production reverts to the use of expensive chrome-nickel steel because in this case crevice corrosion cannot occur, or at least can only occur to a considerably reduced extent, at sections which have been welded together.

The structure of a conventional dishwasher is described by way of example in U.S. Pat. No. 6,045,203. The dishwasher disclosed there has a curved compartment casing which is provided with a flange at the filler opening, which forms a front surface and has rounded upper corners. In order to facilitate the integration of the dishwasher into a fitted kitchen, corner pieces are fitted detachably onto the upper corners in order to create right-angled upper corners. The corners and cladding pieces fitted on the edges are each made from a plastic and are fitted on the flange compartment casing. The corner pieces themselves are secured to the cladding pieces.

The dishwasher described in the US publication likewise reverts to highly corrosion resistant materials with regard to manufacturing, whereby stainless steel is preferred. As a result of the single-piece formation of the compartment casing it offers merely a low level of stability against deformation occurring, during transportation for example. In addition, the fitting of the cladding pieces and also of the corner pieces requires a large number of manual work steps, which further increases the cost of manufacturing.

A dishwasher is known from DE 20 2005 016 735.5 U1 from the applicant in which a frame part having a sealing function made of plastic is arranged at the front end of the compartment casing made of chrome steel, such that corrosion can be avoided in the area of the seal between dishwashing compartment and door.

BRIEF SUMMARY OF THE INVENTION

The object of the present invention consists therefore in providing a dishwasher having a dishwashing compartment which is cost-effective to produce and which also does not have a visually inferior plastic in the front area on the compartment casing.

A dishwasher according to the invention, in particular a domestic dishwasher, comprises a dishwashing compartment for accommodating items to be washed and means for applying wash liquor to the items to be washed, a compartment casing consisting at least in part of stainless metal, in particular stainless steel, having two side walls, a top plate and a rear wall as the upper part of the dishwashing compartment and a dishwasher tray as the base plate of the dishwashing compartment, a filler opening on the dishwashing compartment for items to be washed which can be closed by a door, and a frame part with a sealing function for wash liquor is arranged on the front end of the compartment casing, whereby the frame part consists of largely corrosion-resistant or corrosion-resistant metal, in particular stainless steel, and the metal of the frame part has a greater corrosion resistance than the metal of the compartment casing. A sealing function for the frame part for wash liquor means for example that the frame part assumes a sealing function with the compartment casing on account of the connection, for example as a direct connection by means of roll seam welding, or sealing means such as a circumferential sealing ring are arranged in the frame part.

In contrast to the prior art, in which the compartment casing comprising side walls and compartment roof has a single-piece form, provision is made in the case of the invention for this to have a "two-part" form, whereby the further part is a frame part. In other words, the frame part constitutes a part of the compartment casing, and of the dishwashing compartment. A reduction in costs can now be achieved by virtue of the fact that at least the compartment casing, in other words the structural element which essentially forms the side walls and the compartment roof, is formed from a first, inexpensive material, whereas the comparatively small frame part is manufactured from a second material. Because the frame part has a considerably smaller material requirement in comparison with the compartment casing, the frame part can be manufactured from a comparatively expensive material.

It is basically irrelevant in this situation from which material the frame part is manufactured. It is however preferable if the first and the second material are each formed from a stainless steel. In order to reduce costs it is advantageous in this situation if the less expensive chrome steel is used as the first material while the more expensive chrome-nickel steel is used as the second material.

As described in the introduction, when chrome steel and chrome-nickel steel are connected the problem of crevice corrosion normally results. Since this would result over a period of time in impaired functionality of the dishwasher, provision is preferably made to connect the dishwashing compartment and the frame part together in such a manner as to avoid the penetration of humidity in an overlap area which is regularly susceptible to crevice corrosion. Provision is therefore preferably made to provide a sealing element in the overlap area between the frame part and the dishwashing compartment. Through suitable arrangement of the sealing element in the overlap area it is possible to ensure that a structure is created which reliably prevents residual humidity or water from remaining in the overlap area.

By dividing the compartment casing into two parts, in addition to yielding a reduction in production costs it is also possible to achieve an increase in the stability of the dishwasher. By preference, the frame part constitutes a frame element exhibiting load-bearing properties, which is U-shaped in form and is placed with the two legs pointing downwards over the compartment casing.

In a further advantageous embodiment provision is made whereby the frame part is provided at its end facing the compartment interior with a fold on which the sealing element is applied. In combination with the sealing element the fold prevents the penetration of humidity into the overlap area, which cannot be dispelled and can thus cause crevice corrosion.

By preference, the frame part is connected only indirectly with the compartment casing by means of the sealing element. No direct, immediate contact thus exists between the compartment casing and the frame part, with the result that electrochemical corrosion is avoided, for example while using a more base metal in the compartment casing compared with the frame part.

In a further advantageous embodiment the compartment casing has an indentation in the area of the section overlapping with the frame part, in which the sealing element is arranged. The sealing element and the fold in the frame part are accommodated by the indentation, such that an essentially flat inner wall of the dishwashing compartment can be formed.

In a further advantageous embodiment of the invention provision is made whereby the frame part is provided with a seating facility for attaching a door seal. The seating facility can be produced by appropriate folding and/or bending of a section of the cladding piece. The door seal can be attached by simply inserting it into the seating facility or by means of an adhesive bond, a clamped joint or a crimp connection with the frame part.

The frame part advantageously has an outer flange which runs around the filler opening and forms the outer surface of the dishwashing compartment. The dimensions of the outer flange can be chosen such that it closes the gap between the dishwashing compartment and unit walls of the dishwasher. Furthermore, the flange can also be secured to the latter, which results in further increased stability for the dishwasher.

In a further embodiment of the invention the frame part is provided with at least one cut-out. In this situation, it is preferable if one cut-out is arranged in each of the upper corner sections of the frame part. The provision of the cut-outs in the upper corner sections enables a particularly advantageous manufacturing process for the dishwashing compartment, as will become clear from the production method described further below.

In this situation it is also preferable if in each of the cut-outs a corner frame part is arranged which is connected in a form-fitting and/or force-fitting manner to the frame part and which essentially forms right-angled upper corner sections in the plane of the outer flange of the frame part. While on the one hand the provision of the corner frame parts represents an additional production step, it does however on the other hand enable particularly simple production of the dishwashing compartment, which yields high potential cost savings in comparison with the additional corner frame parts. From the manufacturing engineering perspective, in particular this yields the advantage that on account of the cut-outs provided the areas to be bent are not subjected to any excessively great material stresses when compared with a conventional arrangement in which essentially rectangular upper corner sections must be formed by the material of the compartment casing.

In addition, the corner frame parts make an important contribution to increasing the stability of the dishwasher. These are preferably designed for the force absorption of forces acting laterally and/or from above and/or from below on the shipping housing. The forces to be absorbed by the corner frame parts and discharged into the dishwashing compartment occur, amongst other occasions, during transportation and handling of the dishwasher when a large number thereof are stacked one upon the other and are transported for example by means of a grab forklift which exerts pressure laterally on the housing of the dishwasher.

It is in principle unimportant from which material the corner frame parts are formed. By particular preference, these consist of a plastic because the desired form of the corner frame parts including a force-absorbing structure can be manufactured particularly simply by using injection molding technology.

The corner frame parts are advantageously connected to the outer flange of the frame part. The connection between corner frame part and frame part can in principle be made in any desired manner, whereby screwed, riveted or welded connections lend themselves in particular.

The rear wall preferably consists of the same material as the compartment casing, whereby a seal is used if necessary to connect the two part-pieces in order to also avoid crevice corrosion in this area. The base part, the dishwasher tray in the case of a dishwasher, can be formed from any desired material. By preference, dishwasher trays made of plastic have been used in recent times because the connection with a compartment casing made of steel is unproblematic in respect of the corrosion resistance. If necessary, seals should be used in an appropriate manner for the connection of base part and compartment casing. The dishwasher tray as the base plate of the dishwashing compartment is normally a base part of the dishwasher. The base part is preferably designed as a mounting base, such that it can serve not only as bracing on the base but can also accommodate equipment units, such as pumps, valves or heaters. When designed as a mounting tray it can also hold leakage water and, in combination with a leakage water detection facility, it can detect and thus also report leakage water.

The material connection of the compartment casing to the frame part makes possible a particularly simple and precise connection. A welded connection is preferably used as the connection technology. Apart from this, form-fitting and/or force-fitting connections, screwing together or clamping for example, can also come into consideration.

In summary, the invention can be seen to consist in the fact that a compartment casing of a dishwashing compartment is manufactured from a simple, inexpensive steel, chrome steel for example, while a frame part preferably having a material connection with the compartment casing is manufactured from a higher-grade special steel, which is more resistant to corrosion under all conditions, chrome-nickel steel for example. As a result, the compartment casing can be manufactured from low-cost steel, crevice corrosion and visually inferior plastic can be avoided in the front area of the dishwashing compartment.

BRIEF DESCRIPTION OF THE DRAWINGS

Further advantages, embodiments and expediencies of the invention will be described in detail in the following with reference to the figures.

FIG. 1 shows a perspective illustration of a dishwashing compartment of a dishwasher according to the invention. The figure shows the dishwashing compartment 1 viewed towards its filler opening 2. The dishwashing compartment consists of a compartment casing 30, which has side walls 31, 33 and a roof 32, and also a rear wall 34 connected to the compartment casing 30. Also shown schematically is a base part 40 having the form of a dishwasher tray 42. The dishwasher tray is preferably part of a mounting base as the base part of the dishwasher according to the invention. A pump 44 and a heater 46 are also shown schematically. The compartment casing 30 is a single piece made from a chrome steel. Likewise, the rear wall 34 is normally also made from a chrome steel. Means intended to prevent crevice corrosion, an elastic sealing mass for example (not shown), are arranged at the gap between compartment casing 30 and rear wall because simple chrome steel is used which rusts when constantly wetted with water or humidity. The rear wall 34 is normally secured to the compartment casing 30 by means of roll seam welding.

A frame part 3, which is a component part of the dishwashing compartment, has a material connection with the compartment casing 30 through welding, spot welding for example. The frame part 3 consists of a higher-grade special steel, chrome-nickel steel for example. The problems regarding corrosion resistance when connecting chrome steel to chrome-nickel steel can be eliminated by means of suitable sealing measures. A more detailed description of the manner in which this is implemented will be given in conjunction with FIG. 2.

Since the frame part 3 is designed to be considerably smaller in comparison with the compartment casing and thus requires considerably less material, substantial cost savings can be achieved. In this situation, there is no need to make any cutback whatsoever with regard to the quality of the corrosion resistance on account of the inventive concept of the "two-part" compartment casing.

Figure 1:
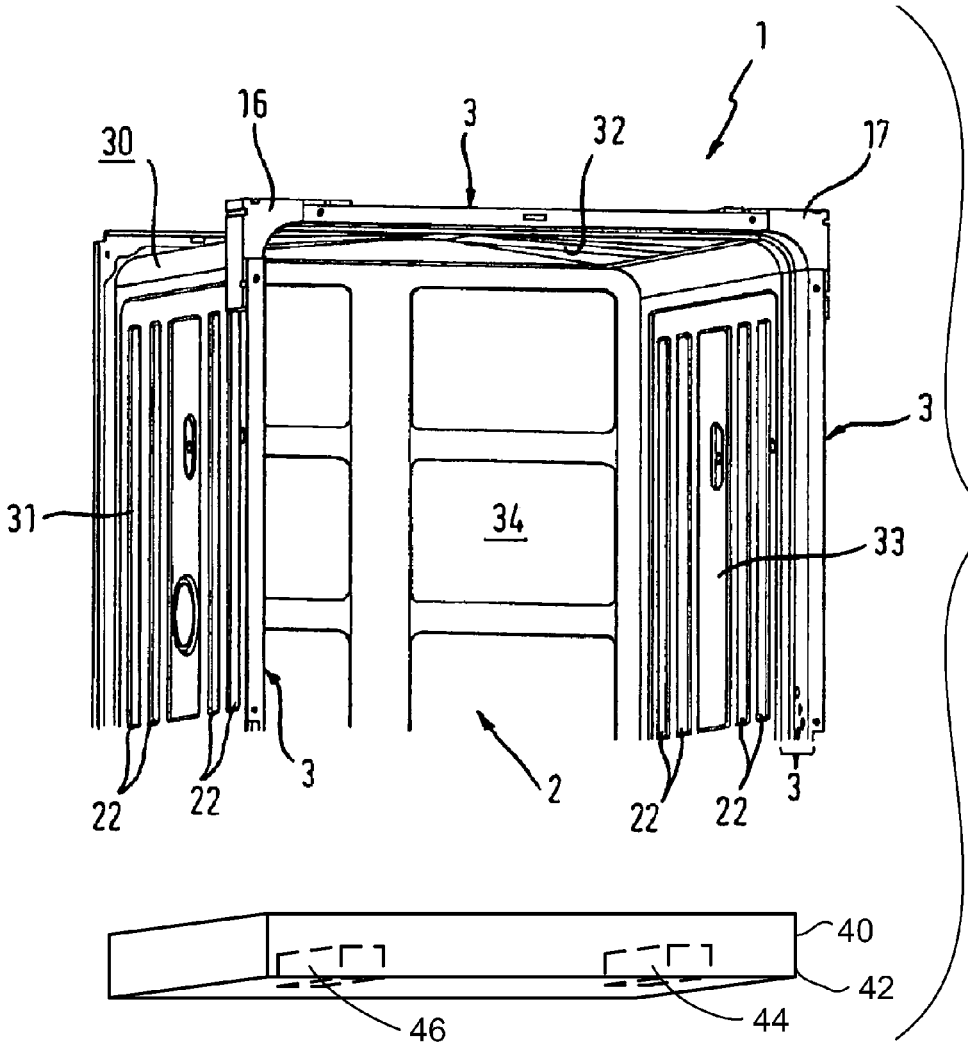
FIG. 1 is a perspective view of a dishwashing compartment of an exemplary embodiment according to the invention.
Figure 2:
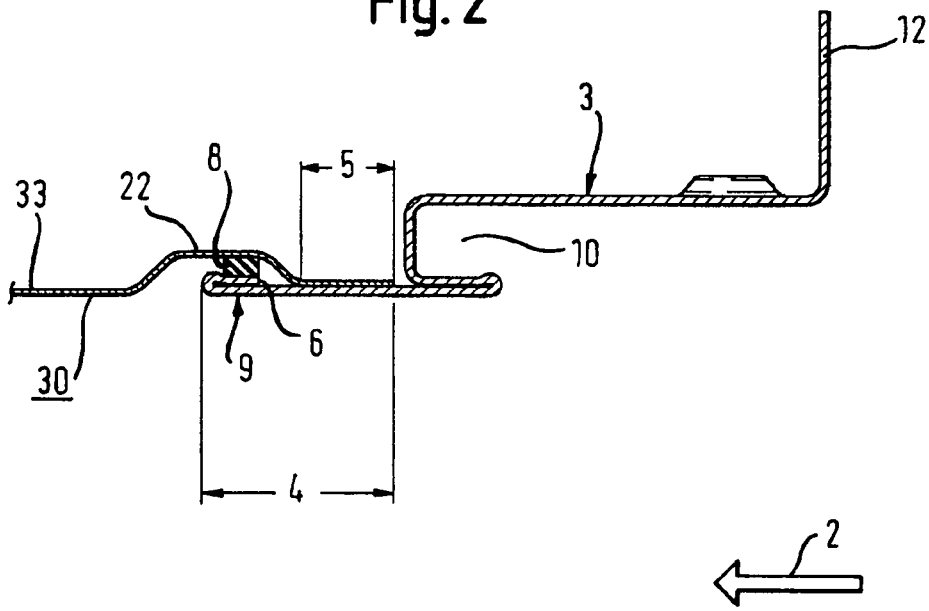
FIG. 2 is a cross-sectional view of a transition region between a compartment casing and a frame of the exemplary embodiment of FIG. 1.

FIG. 2 shows a cross-sectional illustration of the connection of the frame part 3 with the compartment casing 30. More precisely, the connection is illustrated in the area of the side wall 33. In this situation the lower side of the figure is facing the compartment interior. The filler opening is situated at the point identified by the reference character 2, whereby filling of the dishwasher takes place in the direction indicated by the arrow.

The side wall 33 has an indentation 22. Into this indentation 22 projects one end of the frame part 3, as a result of which is formed an overlap area 4 between the frame part 3 and the side wall 33 of the compartment casing 30. In a section identified by the reference character 5 the side wall 33 and the frame part 3 are connected together by a material connection, by way of a welded joint for example. The region facing the compartment interior is particularly susceptible to crevice corrosion. A sealing element 8, made of rubber or silicone or another suitable material for example, is therefore incorporated between the side wall 33 and the folded-over end 9 of the frame part 3, which prevents humidity and water from penetrating in the direction of the welded joint 5. The fold 9 furthermore ensures that the end region 6 of the frame part 3 is similarly not exposed to any humidity or any water, thereby eliminating corrosion. The welded joint and the sealing element 8 and also the cross-sectional form illustrated in FIG. 2 extend uninterrupted from the side wall 33 across the roof 32 to the opposite side wall 31.

On the side facing away from the compartment interior the frame part 3 is folded or bent in such a manner that it has a seating facility 10 to accommodate a door seal. The flange 12 provided at the end of the frame part 3 facing away from the filler opening can also be clearly seen.

Figure 3:
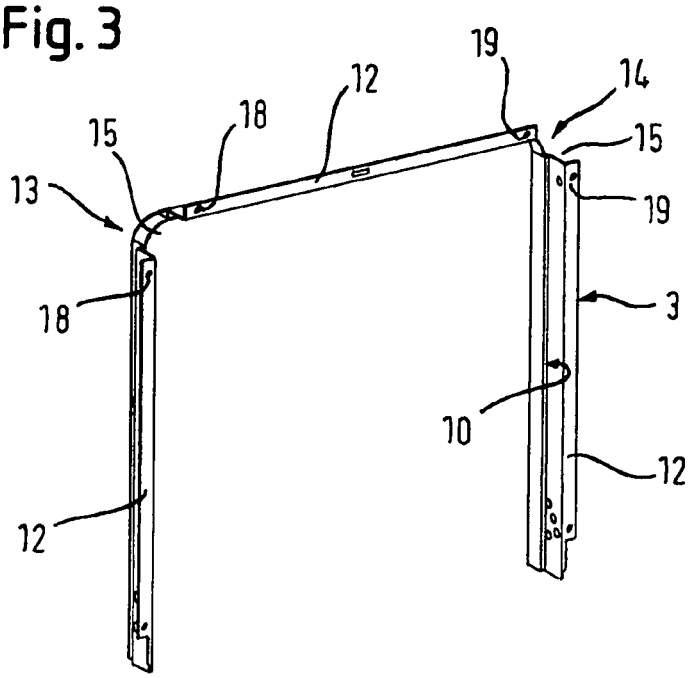
FIG. 3 is a perspective view of an exemplary frame according to the invention.
Figure 4:
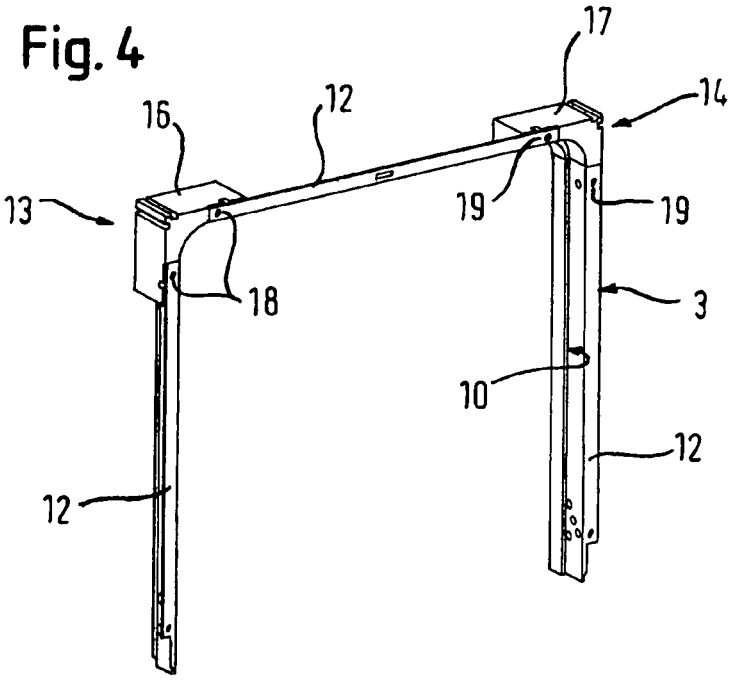
FIG. 4 is a perspective view of another exemplary frame according to the invention, which is connected to corner frames.

The design of the frame part 3 can be seen better in each of the perspective illustrations in FIGS. 3 and 4. From FIG. 3 it can be seen that the frame part 3 has a cut-out 15 in each of its upper corner sections 13, 14. The cut-outs 15 would not be required in principle for the concept according to the invention, but they do facilitate the manufacture of the dishwashing compartment according to the invention. On account of the cut-outs 15, the frame part can be fashioned more easily into the final form shown in FIG. 3. In this situation it should be noted that the bending of the frame part 3 takes place only when a positive connection between the initially "flat" frame part and the compartment casing, consisting of side walls 31, 33 and roof 32, has already been made. The provision of the cut-outs results ultimately in a weakening of the material in these regions, as a result of which the desired radius can be achieved in a simple manner.

Figure 5:
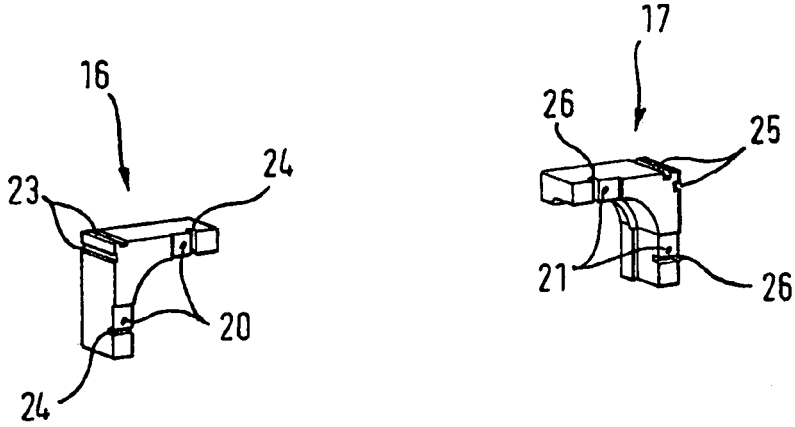
FIG. 5 is an enlarged view of the corner frames of FIG. 4.

It can be seen from FIG. 4 that corner frame parts 16, 17 which increase the stability of the frame part are inserted into the corner sections 13, 14. The corner frame parts 16, 17 are preferably manufactured from a plastic and have a positive connection to the outer flange 12 of the frame part 3. For this purpose, holes 18 and 19 are provided in the outer flange which are assigned to holes 20 and 21 respectively in the corner frame parts 16, 17 (FIG. 5). By this means, fixing can be accomplished by means of screws or rivets. In principle, any other appropriate fixing method is naturally also suitable.

The corner frame parts 16, 17 have grooves 23, 24 and 25, 26 respectively to increase their stability. On the side not shown in the figure these can moreover be provided with bars in order to achieve further stability.

The corner frame parts 16, 17 assume two functions. Firstly, they ensure a right-angled finish in the upper corner sections 13, 14 of the dishwashing compartment. Secondly, the corner frame parts 16, 17 serve to absorb the forces which are exerted on the dishwasher during transportation and handling. In this case it is necessary to take into consideration the fact that transportation handling of a dishwasher is carried out using a so-called grab forklift which transports the dishwasher whilst exerting lateral pressure on it. In this situation, a plurality of dishwashers stacked one above the other can also be transported simultaneously using a grab forklift, with the result that the corner frame parts 16, 17 absorb force not only in the lateral direction but also in the vertical direction.

The invention claimed is:

1. A domestic dishwasher having a washing compartment in which dishes are washed, the dishwasher comprising:

a compartment casing formed from a first metal, the compartment casing having a top plate and two side walls partially defining the washing compartment, the top plate having a front edge and the side walls each having a front edge;

a one-piece U-shaped frame formed from a second metal that is different from the first metal, the frame being continuously connected to the front edge of the top plate and the front edges of the two side walls of the compartment casing at a connection seam; and a seal attached to the frame and attached to the compartment casing, the seal positioned between the connection seam and an interior space of the washing compartment such that the seal prevents wash liquor from contacting the connection seam.

2. The dishwasher of claim 1, further comprising a wash liquor applicator.

3. The dishwasher of claim 1, wherein the first metal is stainless steel.

4. The dishwasher of claim 1, further comprising a dishwasher tray that defines a base plate of the dishwashing compartment and wherein the compartment casing defines an upper part of the dishwashing compartment, wherein the compartment casing comprises the two side walls, the top plate, and a rear wall of the dishwashing compartment, and wherein the dishwasher tray comprises plastic.

5. The dishwasher of claim 4, wherein the base plate forms a part of a mounting tray, and further comprising a pump and a heater in said mounting tray.

6. The dishwasher of claim 1, wherein the frame seals a front of the dishwasher.

7. The dishwasher of claim 1, wherein the second metal is stainless steel.

8. The dishwasher of claim 1, wherein the frame is connected to the compartment casing by one of a form-fitting, force-fitting, and a material manner.

9. The dishwasher of claim 1, wherein the seal is in an overlap area between the frame and the compartment casing, the frame is indirectly connected to the compartment casing by the seal, the frame comprises a fold receiving the seal, and the compartment casing comprises an indent receiving the seal in an overlapping section with the frame.

10. The dishwasher of claim 1, wherein the frame comprises a seat for attaching a door seal.

11. The dishwasher of claim 1, wherein the frame comprises an outer flange that forms front-facing outer surface of a dishwashing compartment.

12. The dishwasher of claim 1, wherein the frame comprises a cut-out, wherein the cut-out is in an upper corner section of the frame, and further comprising a corner frame connected to the frame at the cut-out, and wherein the corner frame is connected to the frame by one of a form-fitting and a force-fitting manner.

13. The dishwasher of claim 12, wherein the corner frame forms a right-angled corner section in a plane of an outer flange of the frame.

14. The dishwasher of claim 12, wherein the corner frame reinforces the frame against forces acting in a lateral direction, from above, or from below on a housing of the dishwasher.

15. The dishwasher of claim 12, wherein the corner frame comprises plastic.

16. The dishwasher of claim 12, wherein the corner frame is connected to an outer flange of the frame.

17. The dishwasher of claim 1, wherein one of the compartment casing and the frame comprises chrome-nickel steel.

18. The dishwasher of claim 1, wherein the frame is connected to the compartment casing such that a front face the frame is visible from a front of the dishwasher when a door of the dishwasher is in an open position, and the front face of the frame is not visible from the front of the dishwasher when the door of the dishwasher is in a closed position.

19. A method for producing a dishwashing compartment for a dishwasher, comprising:

providing a compartment casing;

providing an elongated extension having a plate-shaped section;

bending the elongated extension to form a u-shaped frame;

connecting the frame to a front end of the compartment casing at a front edge of a top of the compartment casing and at front edges of two sides of the compartment casing at a continuous connection seam, and providing a seal attached to the frame and attached to the compartment casing, the seal positioned between the connection seam and an interior space of the washing compartment such that the seal prevents wash liquor from contacting the connection seam.

20. The method of claim 19, wherein the frame is connected to the compartment casing such that a front face of the frame is visible from a front of the dishwasher when a door of the dishwasher is in an open position, and the front face of the frame is not visible from the front of the dishwasher when the door of the dishwasher is in a closed position.

* * * * *

UNITED STATES PATENT AND TRADEMARK OFFICE

CERTIFICATE OF CORRECTION

PATENT NO. : 8,440,027 B2
APPLICATION NO. : 12/085069
DATED : May 14, 2013
INVENTOR(S) : Bühlmeyer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1096 days.

Signed and Sealed this
Eighth Day of September, 2015

Michelle K. Lee

Michelle K. Lee
*Director of the United States Patent and Trademark Office*